US006120015A

United States Patent [19]

Albright et al.

[11] Patent Number: 6,120,015

[45] Date of Patent: Sep. 19, 2000

[54] DUAL SHEET HOLE PUNCHING SYSTEM FOR THE OUTPUT OF REPRODUCTION APPARATUS

[75] Inventors: Roger N. Albright, Fairport; Thomas Acquaviva, Penfield, both of N.Y.

[73] Assignee: Xerox Corporation, Stamford, Conn.

[21] Appl. No.: 09/166,244

[22] Filed: Oct. 5, 1998

[51] Int. Cl.[7] ..... B26F 1/04

[52] U.S. Cl. ..... 270/58.07; 83/618; 83/624

[58] Field of Search ..... 270/58.07, 58.08; 83/618, 620, 624, 30; 399/407

[56] References Cited

U.S. PATENT DOCUMENTS

| | | | |
|---|---|---|---|
| 4,611,741 | 9/1986 | Wilson | 412/37 X |
| 4,632,533 | 12/1986 | Young | 355/3 |
| 4,819,021 | 4/1989 | Doery | 355/13 |
| 5,560,309 | 10/1996 | Conley, Jr. et al. | 414/222 X |
| 5,628,502 | 5/1997 | Amarakoon | 270/58.07 |
| 5,685,532 | 11/1997 | Amarakoon | 270/58.07 |
| 5,762,329 | 6/1998 | Nakazato et al. | 270/58.09 |

FOREIGN PATENT DOCUMENTS 0 315 734 B1 4/1994 European Pat. Off. .

*Primary Examiner*—Christopher P. Ellis
*Assistant Examiner*—Patrick Mackey

[57] ABSTRACT

An on-line sheet hole punching system for punching holes in sheets outputted by a printing system, to eliminate pre-punched sheets, with a common sheet entrance path, two separate but closely vertically superposed sheet paths, a gating system alternately gating the unpunched sheets into one of said two separate sheet paths having respective separate, but shared components, sheet punching stations with commonly reciprocally vertically driven sheet punches. The sheets are alternatingly stopped and the desired hole patterns are alternatingly punched, and the sheets ejected, in the two separate sheet paths, individually punched, or punched as stacked sets. The separately punched sheets may be remerged in a common output path. Skipped pitches or other printing or output interruptions are avoided. A common vacuum system for waste paper punch-outs collection may service both punching stations.

10 Claims, 4 Drawing Sheets

DUAL SHEET HOLE PUNCHING SYSTEM FOR THE OUTPUT OF REPRODUCTION APPARATUS

The disclosed embodiment relates to an improved system of on-line hole punching of printed sheets of paper or other such image substrates being outputted by a copier, printer, or other reproduction apparatus, which is simple, low cost, and compact, and can be easily integrated entirely within an existing compiler/stacker or other sheet output system for said reproduction apparatus.

There is a time, productivity, and potential sheet overlap problem in on-line hole punching of sheets being printed in a high speed printing system. Each sheet to be punched must stop and cannot move relative to the punch making the hole for at least the time it takes the punch to enter the sheet, penetrate through the sheet, and then be removed (fully withdrawn) from the sheet. Furthermore, the sheet must be decelerated and stopped even before then, since it would be difficult or impractical not to stop the sheet before punching begins, i.e., to start punching the sheet while it is still moving rapidly, on the fly, and to try to stop the sheet with the punch itself. That would make it difficult to preclude sheet skewing, or insure proper hole registration—the placement of the holes in the same consistent distance from the edge of the sheet for each sheet of a set to be commonly placed in the same ring binder or the like. Hole misregistration (different hole positions on different sheets) would make it difficult to mount or bind the set and cause visibly uneven outer sheet edges in the set as placed in a ring binder or the like. In addition to the time required for both stopping and punching the sheets, additional time may be required to re-accelerate the sheets up to, or above, the printer process speed, for sheet ejection and/or further sheet finishing, binding or other processing. Yet, all of the above should desirably be done without sheet collisions or inadvertent sheet overlaps in the same sheet path with the subsequent sheets, which are being continuously outputted by the high speed printing system. This is made more difficult by the fact that it is desirable to have as little time and space as possibly between each printed sheet in order to maximize total sheet output productivity, especially for high speed printing. For the same reason, it is undesirable to have skipped pitches or non-print cycles in which no sheet is fed to allow more time and space for hole punching or other finishing. Both result in very little time and space between adjacent sequential printed output sheets in which to provide on-line hole punching.

The disclosed on-line sheet punching system provides a solution to these difficulties and conflicting desired features. It provides on-line hole punching of printer output sheets without skipped pitches or other productivity reductions.

Various specific disclosed features or advantages of the disclosed embodiments, individually, or in combination, include, but are not limited to:

an on-line sheet punching system that alternately deflects and separates printer output sheets into two separate, but preferably closely vertically superposed, sheet paths, which system then alternately punches sheets in two different, but closely vertically superposed, punching positions in those two paths, and in which the punched sheets are then merged from the two paths back into a single common sheet path;

a sheet punching system that punches sheets on-line as they are outputted by a reproduction apparatus within a compact, relatively short, output path, which may be in a compact output module, without requiring either a long horizontal space-consuming variable speed paper path or the skipping of print pitches or other reductions in productivity, yet providing for the time period in which the sheets must be stopped for their punching without the next closely following printed sheet from the reproduction apparatus overrunning and colliding with the preceding sheet or sheets being punched;

a single, shared, common powered punch driver system, located in between two paper punching stations that are in two generally parallel paper paths, driving punches for both punching stations, thereby avoiding the increased cost, space and power consumption of two separate or individually powered punches; and wherein said punching system punches may optionally have a neutral position set by the punch driver system in which the punches are not extending into or obstructing either of the two paper paths;

a sheet temporary stopping and registration system, shared or coordinated with a common punch driver system, for temporarily stopping sheets in the proper position in relation to the punches for punching holes in the correct positions in the sheets;

a single, shared, vacuum waste removal system for paper punchouts (paper waste or confetti) from two separate sheet punching stations; and an on-line sheet punching system that alternately deflects and separates printer output sheets temporarily into two separate sheet paths, with two separate punching positions, and then alternately punches sheets in the two different punching positions, and then merges the sheets back into a single sheet path, wherein either alternating individual sheets are being punched individually or collated sets of plural sheets, or a preset plural number of sheets, are simultaneously commonly punched and outputted.

In one disclosed embodiment, sequentially printed sheets are individually hole punched, one sheet at a time, as each sheet is outputted, alternatingly in two different sheet paths, without interrupting their rapid sequential sheet printing and output, yet allowing improved, more positive, sheet control and a lower punching force as compared to compiling and hole punching through an entire set of sheets at once;

In another disclosed embodiment, sets of plural sheets can be alternately compiled and stacked in the two respective punching stations and alternatingly commonly punched and outputted as sets of plural sheets, and, for example, outputted as sets directly into a binding or other finishing station and/or module.

As will be understood in the art, the punched individual sheets or punched sets of sheets can be further stapled, bound, or otherwise finished downstream in a finishing station or finishing module.

As will be understood by those skilled in the art of paper punching, a correspondingly apertured anvil, either stationary or moving, will normally be provided on the opposite side of the paper paths and punching stations through which the punches extend in their punching operation. That and other well-known aspects of paper punching need not be described herein.

As further disclosed in one embodiment, the sheet or sheets punching system may include a sheet normal force or sheet pressdown feature acting on the sheet or sheets before punching.

Since the sheet edge registration position and/or the punching position on the sheet (the selected margin or edge area of the sheet and the spacing from that sheet edge) may depend on whether the sheets enter the punching station face up or face down, or with the inside or outside edge of the sheet leading, and for either lead edge sheet margin area or rear edge sheet margin area punching, a conventional sheet inverter can be optionally provided anywhere in the sheet path upstream, if desired, and this is shown in one embodiment. Such sheet inverters are often already available for use in the reproduction apparatus paper path, e.g., for duplex printing.

As well be understood in the art, the number of punches and their positions will vary depending on whether 2, 3 or more punch holes are desired in the particular print job or output, whether the long or the short edge of the sheet is being punched, etc. The punches are preferably repositionable and/or removable for that flexibility. However, the punch driver, etc., can remain the same.

Also, only selected sheets of the printer output may be punched, and others fed through one or both paper paths without being punched, if desired. This can be accomplished simply by the print job or printer software control of the actuation or non-actuation of the punch driver.

By way of background, as noted in the below-cited U.S. Pat. No. 5,628,502 and elsewhere, users of copiers, printers, or other reproduction apparatus frequently desire their print jobs to be outputted as sets of printed sheets already pre-punched, so that the job sets can be directly or even automatically put into three ring, two ring, or other standard notebooks or binders. Such binders typically require sheets with holes of an appropriate known standard number and known standard spacing from the edge margin of the sheet and from one another. As also noted in said U.S. Pat. No. 5,628,502, this is now more commonly provided by loading pre-punched paper stock into the copier or printer and then printing on those pre-punched sheets. That has several disadvantages. First, it requires the pre-ordering, purchasing, stocking, and warehousing of such special pre-punched paper or transparencies, so that it is available when such print jobs are needed. Several different weights, sizes, and/or colors of such special use pre-punched paper may thus be required to be stored on hand, with associated inventory, storage, and other costs. Secondly, pre-punched holes in the sheets can interfere with proper feeding or printing of such sheets; for example, by falsely actuating or triggering lead or trail edge sheet sensors in the sheet feeding path of the printer or copier. Thirdly, since the first or odd page of the print job must have the pre-punched holes on the left margin of the sheet, not the right margin, and so forth for subsequent pages, the orientation in which such pre-punched sheets are loaded into the copier or printer is critical for proper orientation of the printed image relative to the holes. Such pre-punched stock is, of course, not even available for roll or web fed copiers or printers, as opposed to normal pre-cut sheet fed copiers or printers. Nor is it generally suitable for letterhead or other pre-printed or orientation sensitive paper stock.

To overcome the above and other disadvantages of pre-punched (also referred to as pre-drilled) paper stock, some copiers have begun to offer on-line hole punching of the sheets, one sheet at a time, sequentially during or immediately after the printing process in the copier, so that conventional unpunched blank copy sheet stock may be utilized, yet provide appropriately punched print jobs in the output. Also, it has been suggested in prior patents. Noted, for example, is Xerox Corporation U.S. Pat. No. 4,819,021 issued Apr. 4, 1989 to Michael S. Doery, noting particularly the left-hand sides of FIGS. 3 and 4, and Col. 8 (D/86170). Also, Xerox Corporation U.S. Pat. No. 5,685,532 issued Nov. 11, 1997 (D/96122), and U.S. Pat. No. 5,628,502 issued May 13, 1997 (D/96338), both to Kiri B. Amarakoon. IBM Technical Disclosure Bulletin Vol. 22, No. 8A, January, 1980, pages 3119–3120, discloses a multiple pattern rotary punch of a type previously used for punching rolls of web-like material, for use in in-line copier or offset press oscillatory punching of single copy sheets. The punch device disclosed can be fitted with different arrays of hole patterns, it is also stated. Mead Corporation U.S. Pat. No. 4,575,296 issued Mar. 11, 1986 to Kockler, et al, especially the bottom of Col. 3, and reference No. 40, also suggests on-line hole punching. Also, Canon U.S. Pat. No. 4,763,167 issued Aug. 9, 1988 to T. Watanabe, et al; and Mita U.S. Pat. No. 5,508,799. On-line hole punching of the copier output is believed to have been available in a Konica "7090 RF" product since approximately 1988. Noted is Konica U.S. Pat. No. 4,988,030. These references also note that on-line hole punching can be provided with or without stapling or other set binding in addition thereto, a feature for which the disclosed embodiments are also compatible.

Of particular interest in another respect is EPO 13.04.94 publication No. 0 315 734 B1 by Uto Nobutaka (Canon). The Col. 1 "Field of the invention" section notes a sheet handling apparatus including a post-processing device to be connected to an image forming apparatus such as a copier or printer for stacking the sheets discharged from said apparatus and collating, stapling or punching said sheets. However, the actual disclosure, in, e.g., Cols. 11 and 12, teaches feeding sheets into two paths and then ejecting the sheets together for stacking and stapling after their common ejection, when they are part of an output stack, to avoid time delays and improve productivity. As may be seen in this reference, there is no stapling in the two separate sheet paths, which merely serve to hold back one sheet to allow time for stapling the prior ejected sheet set, and there is no actual enablement or teaching of any hole punching.

Also of interest as to prior post-processing dual sheet path output systems is Canon European patent application publication number 0 315 734 published 13.04.94. Also, a dual sheet path decurler printed sheet output is disclosed in Xerox Corp. U.S. Pat. No. 4,632,533 issued Dec. 30, 1986.

Of interest to the exemplary disclosed embodiment feature of one example of sheet registration with the sheet lead edge captured within a temporarily stalled nip is Xerox Corp. U.S. Pat. No. 5,775,690 issued Jul. 7,1998.

The disclosed system is usable with a wide variety of sheet output compilers and stackers. Some examples include Xerox Corp. U.S. Pat. Nos. 4,541,626; 4,826,383; 5,044,625; 5,201,517; 5,120,047; 5,014,977; 5,289,251; 5,342,034; 5,261,655; and 5,409,202; and other references cited therein. As will be further described herein, one disclosed embodiment integrally incorporates an on-line hole punching system into a compiler/stacker in a manner which is fully compatible with and may cooperatively utilize the sheet entrainment and movement provided by the compiler/stacker, and other elements thereof. This integrated system enables optional on-line hole punching to be provided in the output sheets without any increase in the overall size of the sheet output system, or any reduction in printing speed. Also, the sheet punching as disclosed herein is desirably at the exposed output end of the printing system, and therefore is readily accessible for adjustments, repairs, and, most importantly, jam clearances of any sheet jams or removal of sheets during machine stoppages. That is, the hole punching system disclosed herein need not be buried internally within the copier or printer in an access-restricted location.

As noted above, the disclosed hole punching system provides hole punching on-line, to eliminate the requiring of any pre-punched paper, yet without having to interrupt, even briefly, the sheets printing. Yet, the sheet edge may be conventionally registered and deskewed and stopped before and during hole punching here, for proper positioning of the punched holes in the sheets and for consistent hole positions in the outputted set. Furthermore, existing transverse sheet registration may desirably be utilized to provide transverse registration of the sheet prior to its hole punching.

A specific feature of the specific embodiments disclosed herein is to provide in an on-line sheet hole punching system operatively associated with a sheet printing system for punching holes in the flimsy unpunched sheets being printed by said sheet printing system, to avoid pre-punched sheets in said printing system, the improvement comprising: a common sheet entrance path for said unpunched sheets printed by sheet printing system; two separate but adjacent and generally parallel sheet paths; a sheet path gating system for alternately gating said unpunched sheets in said sheet entrance path into a selected one of said two separate sheet paths; two separate sheet punching stations, each in one of said two separate sheet paths, having driveable sheet punches for punching holes in said unpunched sheets in said two separate sheet paths alternatingly while said sheets are alternatingly stopped in said two separate sheet paths; said two separate sheet paths respectively feeding said sheets from said sheet entrance path and said sheet path gating system to said respective sheet punching stations for said alternating punching of holes in the sheets of said two separate sheet paths to avoid interruptions in said sheet printing system by said on-line sheet hole punching system.

Further specific features disclosed herein, individually or in combination, include those wherein a common, shared components, punch driver system for alternately driving said respective drivable sheet punches in both of said two separate sheet punching stations in both of said two separate sheet paths; and/or a common merging output path connecting both of said two separate sheet paths for the merged output of punched sheets from said two separate sheet punching stations; and/or a common vacuum punch waste paper collection system operatively connecting with both said sheet punchings stations; and/or wherein said sheet path gating system alternately gates single said unpunched sheets in said sheet entrance path into alternate said separate sheet paths, and wherein said two separate sheet punching stations alternatingly punch holes in said single unpunched sheets one sheet at a time; and/or wherein said sheet path gating system alternately gates a sequential plural sheet set of said unpunched sheets in said sheet entrance path into a selected one of said two separate sheet paths, and then into the other of said two separate sheet paths, and wherein said two separate sheet punching stations include a sheet stacking system and are adapted to alternatingly punch holes in said plural sheet sets of unpunched sheets one set at a time as a stacked set; and/or wherein a sheet set ejection system ejects said punched sets of sheets from said sheet punching stations as a stacked set; and/or wherein said two separate sheet paths are relatively short and vertically superposed; and/or wherein one said separate punching station is operative while the other said separate punching station is acquiring and/or ejecting said sheets in its respective said separate sheet path; and/or wherein said two separate punching stations include separate and alternatingly actuated sheet temporarily stopping and registration systems; and/or wherein said two separate sheet paths and said two separate punching stations are vertically superposed, and wherein said drivable sheet punches in both of said two separate punching stations are integral punch members with opposing end punches commonly reciprocally vertically driven by said common punch driver system.

The disclosed system may be operated and controlled by appropriate operation of conventional control systems. It is well-known and preferable to program and execute imaging, printing, paper handling, and other control functions and logic with software instructions for conventional or general-purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. Conventional sheet path sensors or switches connected to the controller may be utilized for sensing, counting, and timing the positions of sheets in the sheet paths, and thereby also controlling the operation of sheet feeders and inverters, as well as the hole punch driver motor or solenoid, etc., as is well known in the art.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of specific embodiments, including the following drawing figures (approximately to scale) wherein:

Figure 3:
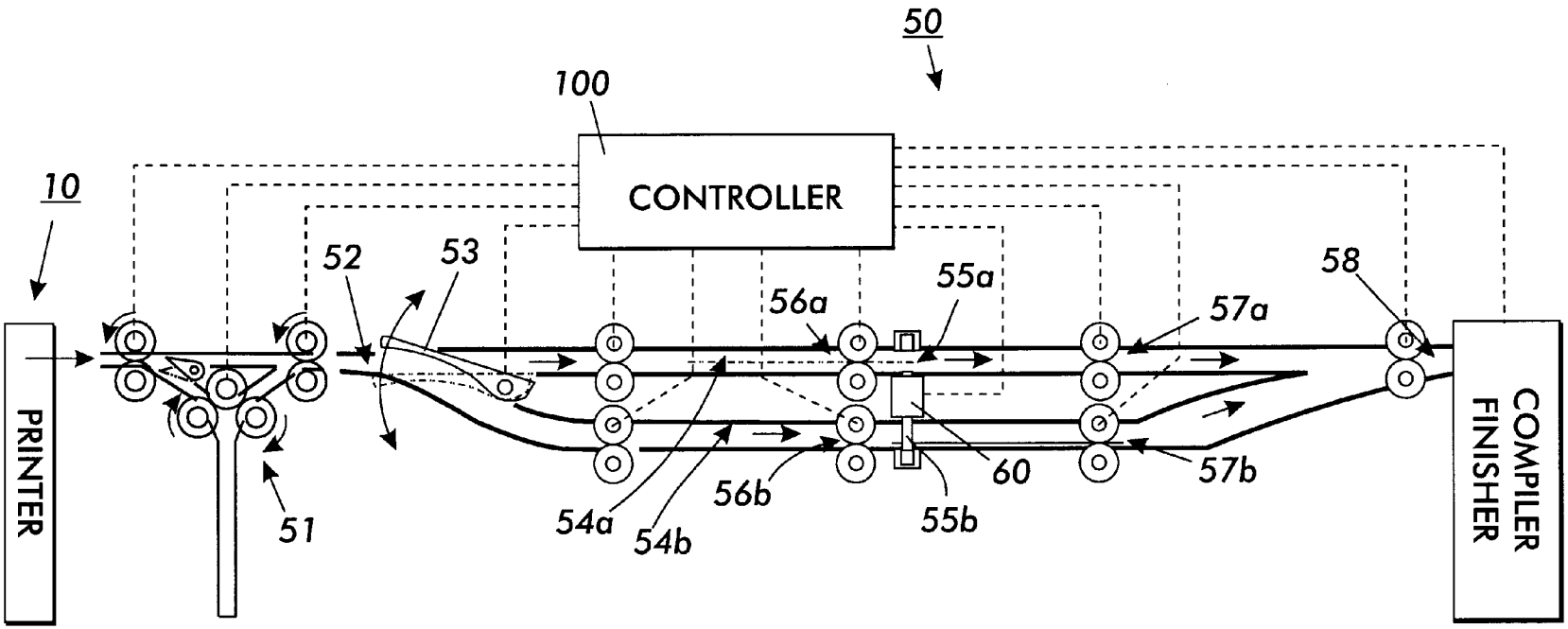
Figure 4:
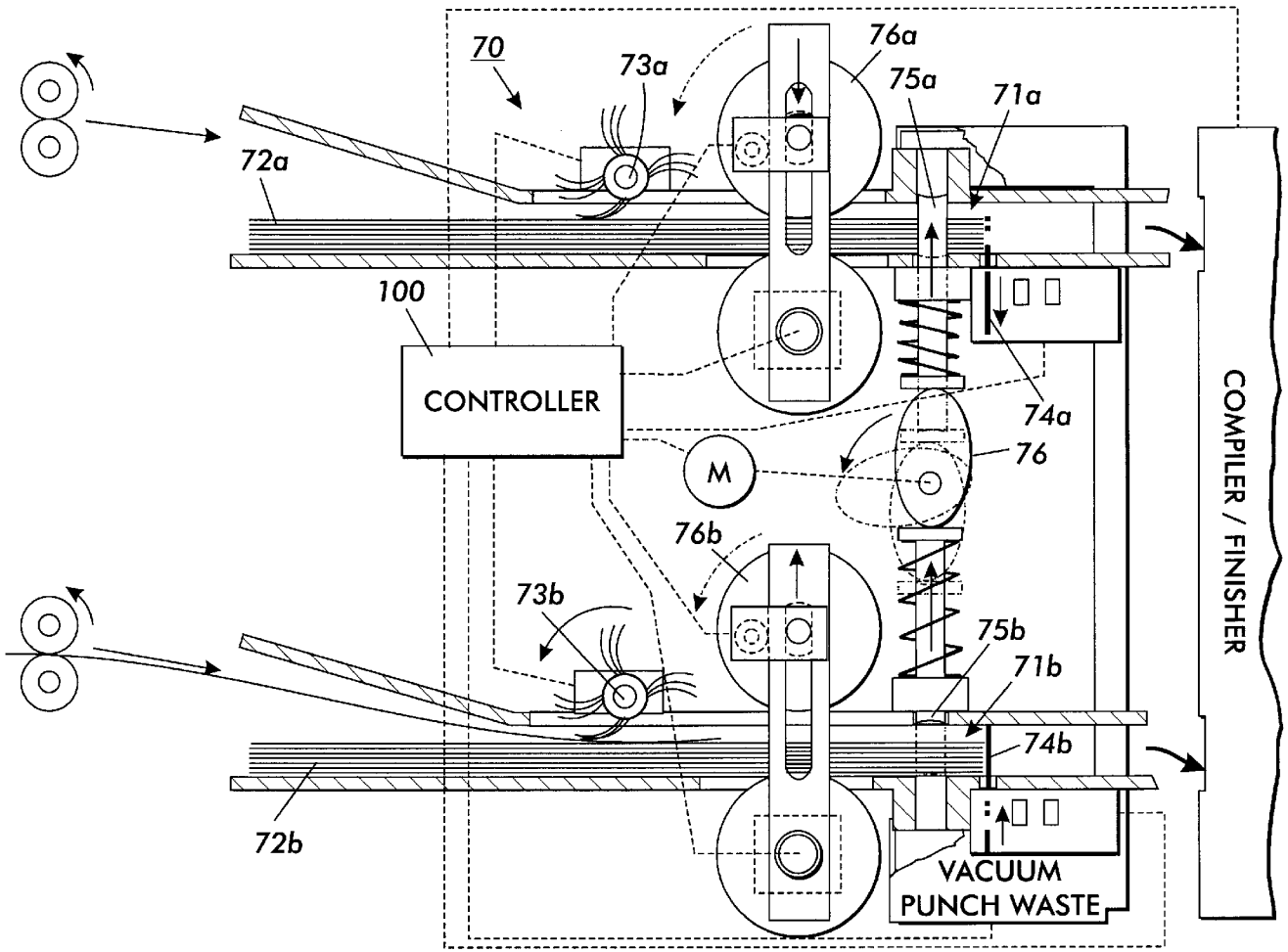

FIG. 3 schematically shows a side view of a second embodiment of the hole punching system, in this case punching the trailing edge area of the sheets, and also showing a conventional sheet inverter in the upstream (incoming) sheet path; and FIG. 4 is an enlarged partially schematic and partially cross-sectioned partial view of a third embodiment, showing one example of a system for registering, compiling, simultaneously punching, and ejecting, stacked sets of plural sheets.

Referring to the examples shown in the FIGS., there are illustrated three different embodiments of an on-line sheet hole punching systems as described there and further described below. Several of the feature or structure descriptions of one embodiment may also be applicable to, or substitutable in, other embodiments. Any of the embodiments may be compactly located at the output end, in the sheet output path, of an otherwise conventional printing system 10, or in a separate but connecting punching module, which can be a separate optional module, or part of an output or finishing module. The punched sheets may, as shown, be conventionally fed on after hole punching to a stacker or compiler/finisher, or a connecting finisher module directly associated therewith for known on-line finishing, such as folding, stapling and/or binding, and/or mailboxing. The same exemplary microprocessor controller 100 may be used for any of the embodiments, since the hole punching operation may desirably be controlled by software sharing the existing microprocessor controller of either the printer or the finisher module.

Figure 1:
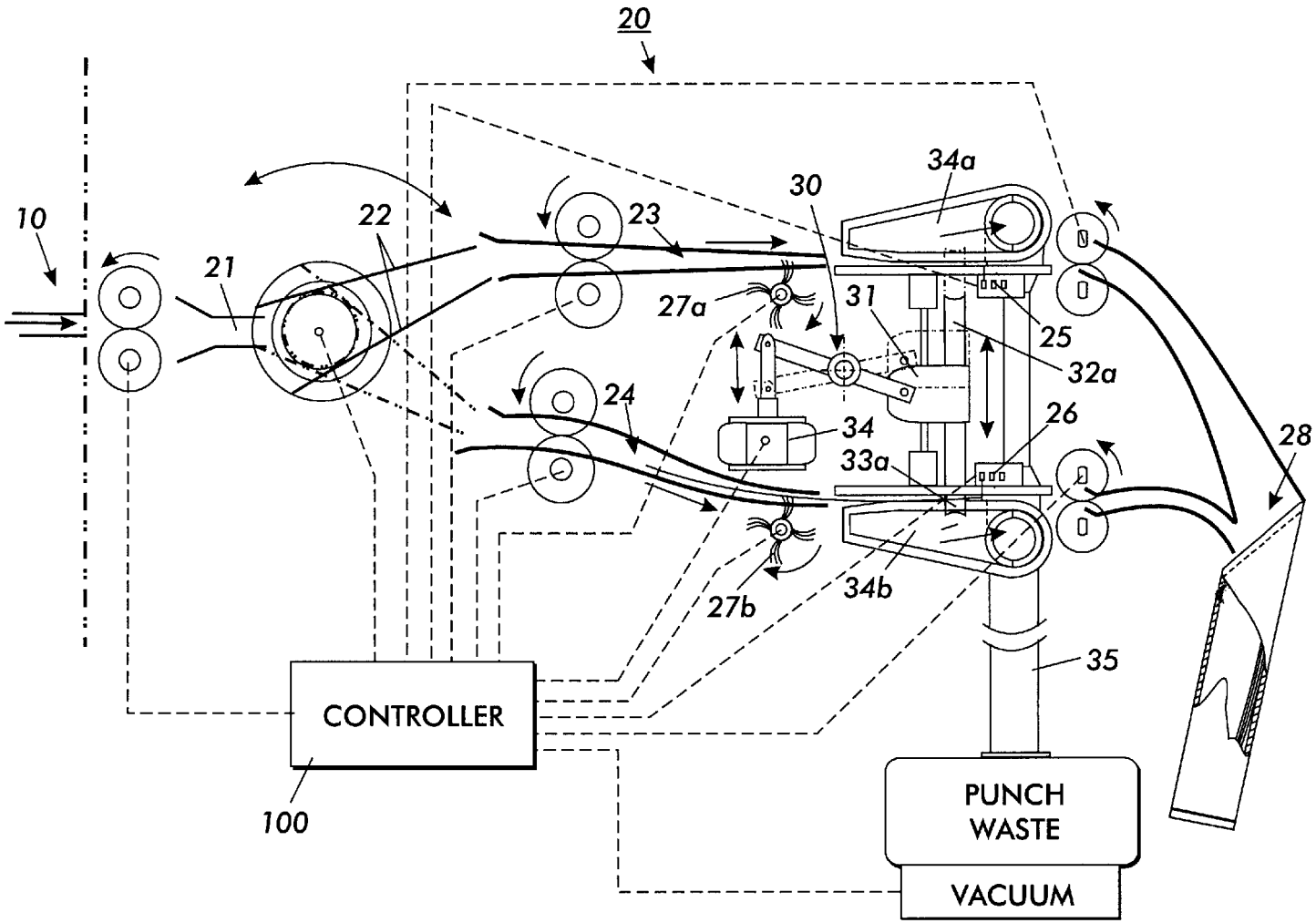
FIG. 1 is a partially schematic side view of one example (a first embodiment) of a subject dual path, shared punch driver, on-line sheet hole punching system for the output of a high speed sheet printing system, shown partially in cross-section, in an arrangement for registering and punching the lead edge area of the sheets.
Figure 2:
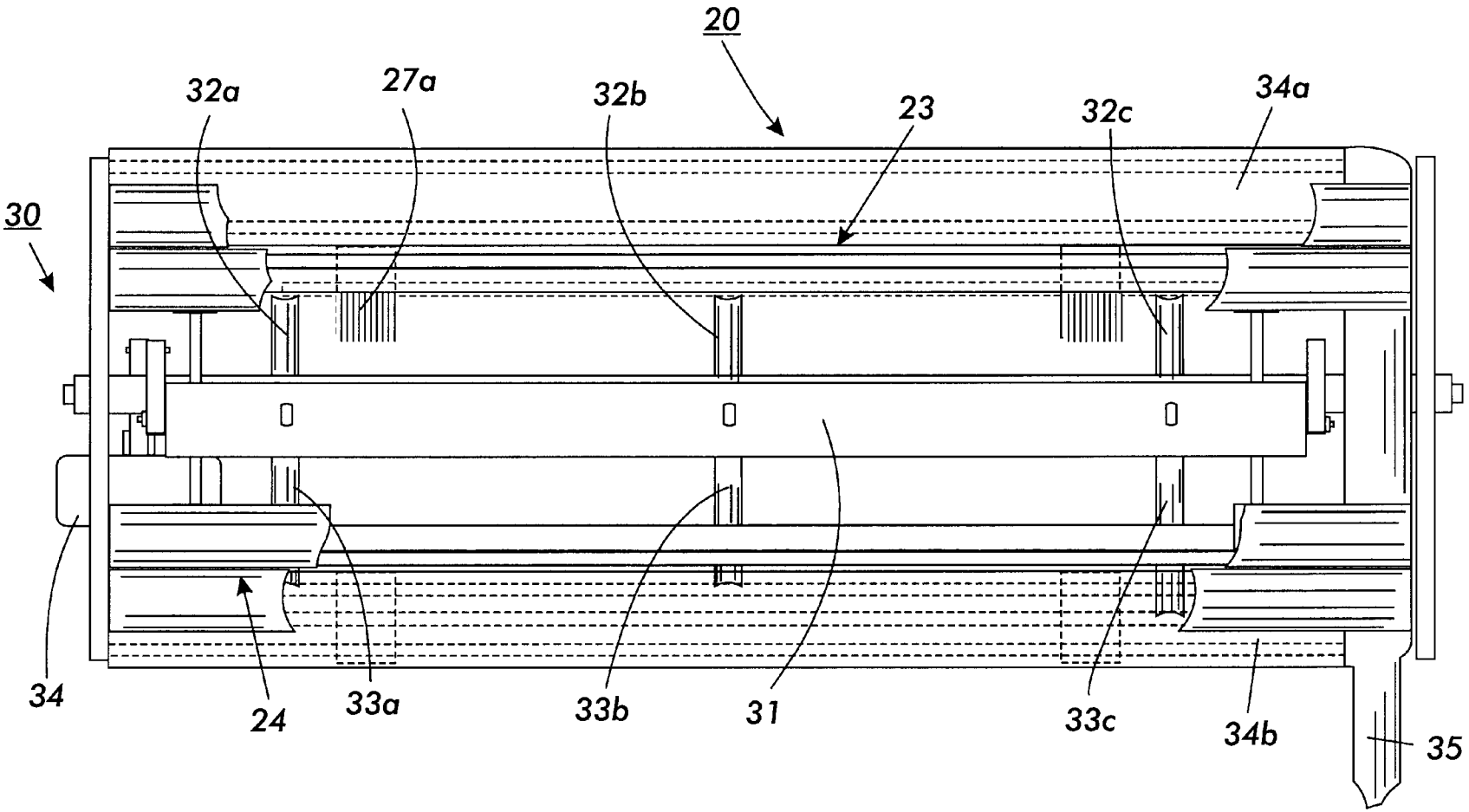
FIG. 2 is a side or end view of the embodiment of FIG. 1, partially broken-away to show an exemplary three-hole punch operation.

Turning now to the exemplary hole punching system 20 illustrated in the FIGS. 1 and 2 example, it may be seen that it takes the rapid sequential output of the printer, as is, in a single paper path entrance 21 to a sheet path deflector or gate 22. The gate 22 deflects the sheet into a selected one of two relatively short separate sheet paths 23 or 24. For compactness, a small footprint, and a shared, common, punch driver system 30, the two paths 23, 24 may closely overly and parallel one another. In this example, a transverse sheet punch assembly 31 is provided with three sheet punches 32*a,* 32*b* and 32*c* on one side, for one sheet path 23, and three other three sheet punches 33*a,* 33*b* and 33*c* on the opposite side, for the other sheet path 24. This provides for (simultaneous or staggered) standard three hole punching by simple reciprocal vertical movement of the sheet punch assembly 31, by the punch driver system 30 solenoid 34, to move one set of punches 32*a,* 32*b* and 32*c* up into sheet path 23 and then to move the other set of punches 33*a,* 33*b* and 33*c* down into the other sheet path 24, to alternatingly punch sheets in the two paths with the same punch driver system 30. This opposite direction reciprocal vertical punching movement and force can alternatively be provided by a cam or cams rotated by a motor M, such as is shown in the FIG. 4 embodiment, or the above-cited U.S. Pat. No. 5,628,502, instead of the solenoid 34 shown here in FIG. 1, for lower impact and quieter operation. The punching force can also be provided by a conventional clutch takeoff from an existing sheet drive of the printing or finishing system. A spring return can be used for one direction of movement if desired.

It will also be appreciated that the punches may preferably be movably mounted on a commonly driven arm assembly such as 31, or other member, so as to allow for their lateral position adjustment or removal, such as being mounted on slide rails or rods, so that the proper position and spacing of the punch hole locations can be reset to the type of binder intended for the sheets, the size of the sheets being punched, the registration position of the sheets being outputted relative to the punches, etc. That is, the number and location of the punches can be changed to suit the particular customer desired hole punching positions. E.g., for conventional two hole punching instead of conventional three hole punching, two of the punches may be moved into the conventional two hole positions, and the third or outboard punch may be moved laterally completely out of the sheet path for that size sheet, so as to be inoperative. Mounting apertures, set screws or other detents may be utilized to hold the punches in their selected lateral positions. They are not subjected to any significant lateral forces. Alternatively, or additionally, a separate camming system may be provided for each punch which is removed or disengaged for one or all of the punches when hole punching is not desired. It will be appreciated that many other alternatives can be provided, especially for the punch actuating system. Also, that the opposing anvil aperture positions may need to be correspondingly changed. If more than one sheet is being punched at a time, set clamping or other normal forces may be provided, e.g., as described in the above-cited U.S. Pat. No. 5,628,502, although single sheet punching is illustrated in the FIGS. 1 and 2 and FIG. 3 embodiments. If the hole punching is for known spiral or other "lay flat" sheet set binding systems, such as binders sold by Renz®, Womako®, Spiral Bind®, Unicoil® or GBC®, then the hole punches may be set for the proper sheet hole punching for the downstream on-line binding for those binding systems, e.g., with 44 small rectangular holes punched close to the sheet edge.

For printers with all or some sheets being outputted short edge first (lengthwise rather than widthwise) the punches may be positioned along one side or edge of the paper paths. Alternatively, a known upstream 90 degree sheet path rotator may be provided.

As discussed in the introduction, before punching is initiated, it is desirable to stop and register and hold the sheet or sheets in the selected desired punching position in the sheet path 23 or 24. Disclosed in the FIGS. 1 and 2 example are independently operated conventional solenoid sheet lead edge registration gates 25 and 26 in the respective sheet paths 23 and 24, for acquiring a lead edge margin of the sheet in that path in the proper position for hole punching. (As shown in FIG. 3, the registration could alternatively be for hole punching in the trailing edge area.) The hole punches here are not actuated until after the binding edge of the sheet has been fully registered in the desired punching station or position, defined by the sheet path baffles and the registration position. Angled rotating brush scuffers 27*a,* 27*b,* or the like, or various other known registration assistance devices, may be optionally provided. Alternatively, the respective sheet stopping, starting and registration may be provided by temporarily stopped or stalled feed roller nips, as in FIG. 3 and the patent thereon cited above. In either case, the operation is alternative between the two sheet paths and their respective punching stations, so that as one is punching a sheet, the other is simultaneously ejecting its (immediately preceding) punched sheet and taking in a new sheet to be punched, without time delays.

After sheets are punched, they are rapidly reaccelerated and ejected by conventional feed rolls, preferably into merging paths to form a common output path, such as 28 in FIG. 1, which may have the same sheet sequence as sheets that entered the common entrance path 21. Thus, at that point, the sheets may be treated in the same manner as the normal output of the printer 10 for stacking and/or finishing.

Also shown in FIG. 1 are vacuum manifolds 34*a* and 34*b* in the respective punching stations in the respective sheet paths. These operatively connect with the hole punch apertures, and the punches extend therein to provide, via a connecting common vacuum duct 35, a single "Punch Waste" "Vacuum" system, so labeled in FIG. 1, for both punching stations. It may conventional have a removable wastepaper container for the "confetti" waste paper punched out from the holes in the sheets.

Turning now to the second on-line sheets punching system embodiment 50 of FIG. 3, as discussed in the introduction, an exemplary known gated sheet inverter 51 is shown in or after the printer 10 output here, upstream of the single input path 52 of the system 50. If the inverter 51 is gated in and used, rather than bypassed, it reverses the lead edge and trail edge of the sheet, as is well known in the art. This enables the hole punching system, if desired, to punch the lead edge area of the sheets rather than the trailing edge area, if desired, and assuming correct page order collation can be maintained. E.g., typically page one of a print job set is hole punched in the left side margin with page one face up, which would be holes in the right side margin if page one is face down.

In FIG. 3, the sheets next enter a path decision gate 53 providing a function like that of gate 22 of FIG. 1. That is, the sheets are alternately directed into an upper sheet path 54*a* or a lower sheet path 54*b*, providing therein an upper punching station 55*a* and a lower punching station 55*b*, respectively, with a commonly solenoid driven punching system 60, generally similar in function to 31, 34 described above. It may have a separate solenoid for each punch. A sheet wait station or deceleration station can also be provided, by the sheet feed roller nips and extended baffles shown upstream thereof, if desired. The sheet trail edge area can be stopped alternately in nips 56*a* and 56*b* for alternately punching the sheets trail edge margin, and the punched sheets re-accelerated by being in closely downstream nips 57*a* and 57*b*. The two sheet paths 54*a* and 54*b* then re-merge into a single output path 58, which feeds the merged sheets directly into a compiler/finisher, as shown.

Turning now to the third embodiment 70 of FIG. 4, only the two hole punching station portions of the sheet paths are shown here for clarity, and it will be appreciated that the upstream sheet path separation system and downstream path merger may be as described above for the other embodiments. This FIG. 4 embodiment 70 is particularly adapted to compile or stack and punch sets of sheets rather than individual sheets, and then to eject them as commonly punched stacked sets. Plural sheets are individually guided and fed in sequentially to the upper sheet path punching station 71*a* or the lower sheet path punching station 71*b* to stack on top of the respective accumulating stack 72*a* or 72*b* there. This may be assisted by conventional stack scuffer or feeder assistance devices such as 73*a* or 73*b* to register against registration gates 74*a* or 74*b*. The sheets are all sequentially directed into one sheet path and punching station until a collated set, or a maximum desired punching thickness set, (both are known to the controller 100) has accumulated in that punching station. The compiling area or tray preferably has scuffing and/or tamping devices, as described above. While one stacked set of sheets 72*a* is being punched all at once by punches 75*a*, and subsequently ejected by lowered rollers 76*a* and lowered registration gate 74*a*, the other (lower) set 72*b* can be accumulating with its rollers 76*b* and its punch set 75*b* raised out of the way, as shown. Then this reverses, for the next cycle.

Each spring-loaded punch or punch set 75*a* or 75*b* operates whenever the respective punch head thereof is engaged and driven in by the punch actuating system, which here is an eccentric cam 76 rotated by Motor M. The punch heads can be simple cam followers, as shown, or may be engaged by an intermediate force multiplying lever system, such as in the FIG. 1 example. Note that as in other punching systems described above, the punch driving system provides a neutral position in which neither punch set is in or obstructing either of the two sheet paths.

Note that with the system 70 of FIG. 4, or with multisheet compiling and punching operation or modification of the other embodiments, where the set integrity is maintained by the downstream feeding rollers or belts, that a separate downstream compiler is not required and the punched sets can go directly into a set binding, finishing or stacking system, and this can provide a compact integral combined punching and finishing module. The finishing can also be done in extensions of the two sheet paths rather than a merged single path, so that no skipped pitches are required for either punching or finishing.

The two respective sheet-stacking areas or trays may be downwardly inclined towards the lead edge registration edge to assist in obtaining and maintaining registration.

Typically, with plural sheet punching, a set clamp is first actuated to grip the set to be punched. Here in this example, the rollers 76*a* and 76*b* can provide that additional or dual function by clamping down onto the top-most sheet in the paper stack and maintain the sheets in alignment with the underlying sheets in the stack throughout the subsequent hole punching process. They are positioned and configured as shown to provide a smooth sheet entrance into the punch system's opening or jaw.

To summarize briefly, the above embodiments disclose an on-line sheet hole punching system for punching holes in sheets outputted by a printing system, to eliminate pre-punched sheets, with a common sheet entrance path, two separate but closely vertically superposed sheet paths, a gating system alternately gating the unpunched into one of said two separate sheet paths having respective separate, but shared components, sheet punching stations with commonly reciprocally vertically driven sheet punches. The sheets are alternatingly stopped and the desired hole patterns are alternatingly punched, and the sheets ejected, in the two separate sheet paths, individually punched, or punched as stacked sets. The separately punched sheets may be remerged in a common output path. Skipped pitches or other printing or output interruptions are desirably avoided. A common vacuum system for waste paper punch-outs collection may service both punching stations.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In an on-line sheet hole punching system operatively associated with a sheet printing system for punching holes in the flimsy unpunched sheets being printed by said sheet printing system, to avoid pre-punched sheets in said printing system, the improvement comprising:

a common sheet entrance path for said unpunched sheets printed by sheet printing system, two separate but adjacent and generally parallel sheet paths, a sheet path gating system for alternately gating said unpunched sheets in said sheet entrance path into a selected one of said two separate sheet paths, two separate sheet punching stations, each in one of said two separate sheet paths, having driveable sheet punches for punching holes in said unpunched sheets in said two separate sheet paths alternatingly while said sheets are alternatingly stopped in said two separate sheet paths, said two separate sheet paths respectively feeding said sheets from said sheet entrance path and said sheet path gating system to said respective sheet punching stations for said alternating punching of holes in the sheets of said two separate sheet paths to avoid interruptions in said sheet printing system by said on-line sheet hole punching system.

2. The on-line sheet hole punching system of claim 1, comprising a common, shared components, punch driver system for alternately driving said respective drivable sheet punches in both of said two separate sheet punching stations in both of said two separate sheet paths.

3. The on-line sheet hole punching system of claim 1, further including a common merging output path connecting both of said two separate sheet paths for the merged output of punched sheets from said two separate sheet punching stations.

4. The on-line sheet hole punching system system of claim 1, further including a common vacuum punch waste paper collection system operatively connecting with both said sheet punchings stations.

5. The on-line sheet hole punching system of claim 1, wherein said sheet path gating system alternately gates single said unpunched sheets in said sheet entrance path into alternate said separate sheet paths, and wherein said two separate sheet punching stations alternatingly punch holes in said single unpunched sheets one sheet at a time.

6. The on-line sheet hole punching system of claim 1, wherein said sheet path gating system alternately gates a sequential plural sheet set of said unpunched sheets in said sheet entrance path into a selected one of said two separate sheet paths, and then into the other of said two separate sheet paths, and wherein said two separate sheet punching stations include a sheet stacking system and are adapted to alternatingly punch holes in said plural sheet sets of unpunched sheets one set at a time as a stacked set, and wherein a sheet set ejection system ejects said punched sets of sheets from said sheet punching stations as a stacked set.

7. The on-line sheet hole punching system of claim 1, wherein said two separate sheet paths are relatively short and vertically superposed.

8. The on-line sheet hole punching system of claim 1, wherein one said separate punching station is operative while the other said separate punching station is acquiring and/or ejecting said sheets in its respective said separate sheet path.

9. The on-line sheet hole punching system of claim 1, wherein said two separate punching stations include separate and alternatingly actuated sheet temporarily stopping and registration systems.

10. The on-line sheet hole punching system of claim 2, wherein said two separate sheet paths and said two separate punching stations are vertically superposed, and wherein said drivable sheet punches in both of said two separate punching stations are integral punch members with opposing end punches commonly reciprocally vertically driven by said common punch driver system.

* * * * *